United States Patent [19]

Walker

[11] Patent Number: 4,596,392

[45] Date of Patent: Jun. 24, 1986

[54] PRACTICE BALL FOR GOLFERS

[75] Inventor: Grant W. Walker, Sacramento, Calif.

[73] Assignees: John M. Blayden; Stefani Blayden

[21] Appl. No.: 519,133

[22] Filed: Aug. 1, 1983

[51] Int. Cl.[4] ..... A63B 69/36

[52] U.S. Cl. ..... 273/183 C; 273/186 D; 273/213; 273/176 L; 273/181 B

[58] Field of Search ..... 273/186 D, 183 C, 199 R, 273/29 A, 26 R, 58 A, 213, 181 B

[56] References Cited

U.S. PATENT DOCUMENTS

| | | | |
|---|---|---|---|
| 1,575,281 | 3/1926 | Rosenberg | 273/199 R |
| 1,580,230 | 4/1923 | Brereton | 273/199 R |
| 3,081,091 | 3/1963 | Grow | 273/186 D |
| 3,721,447 | 3/1973 | Louderback | 273/199 R X |

*Primary Examiner*—George J. Marlo

*Attorney, Agent, or Firm*—Lothrop & West

[57] ABSTRACT

A practice ball for use in simulated golf driving has a claylike, energy-absorbing, deformable core normally substantially spherical, surrounded by an open-work or knit fabric carrying a powder readily dislodged upon impact of said pellet with a hard surface.

2 Claims, 2 Drawing Figures

PRACTICE BALL FOR GOLFERS

BRIEF SUMMARY OF THE INVENTION

A normally spherical pellet has an energy-absorbing, clayey, deformable core encased in a substantially spherical, knit or open-work, two-way stretch fabric cover carrying a marking powder dislodged upon impact of the pellet with a hard surface.

PRIOR ART OF INTEREST

Reference is made to the following United States patents found in a preliminary Patent Office search on this disclosure.

| | |
|---|---|
| U.S. Pat. No. 3,325,168 | Fyanes |
| U.S. Pat. No. 3,634,280 | Dean et al. |
| U.S. Pat. No. 3,637,220 | Fraley |
| U.S. Pat. No. 4,065,126 | Mantz |
| U.S. Pat. No. 4,150,826 | Baldorossi et al. |

None of these patents is possessed of the structural features or performance characteristics of the structure disclosed and claimed herein.

DETAILED DESCRIPTION

Figures 1, 2:
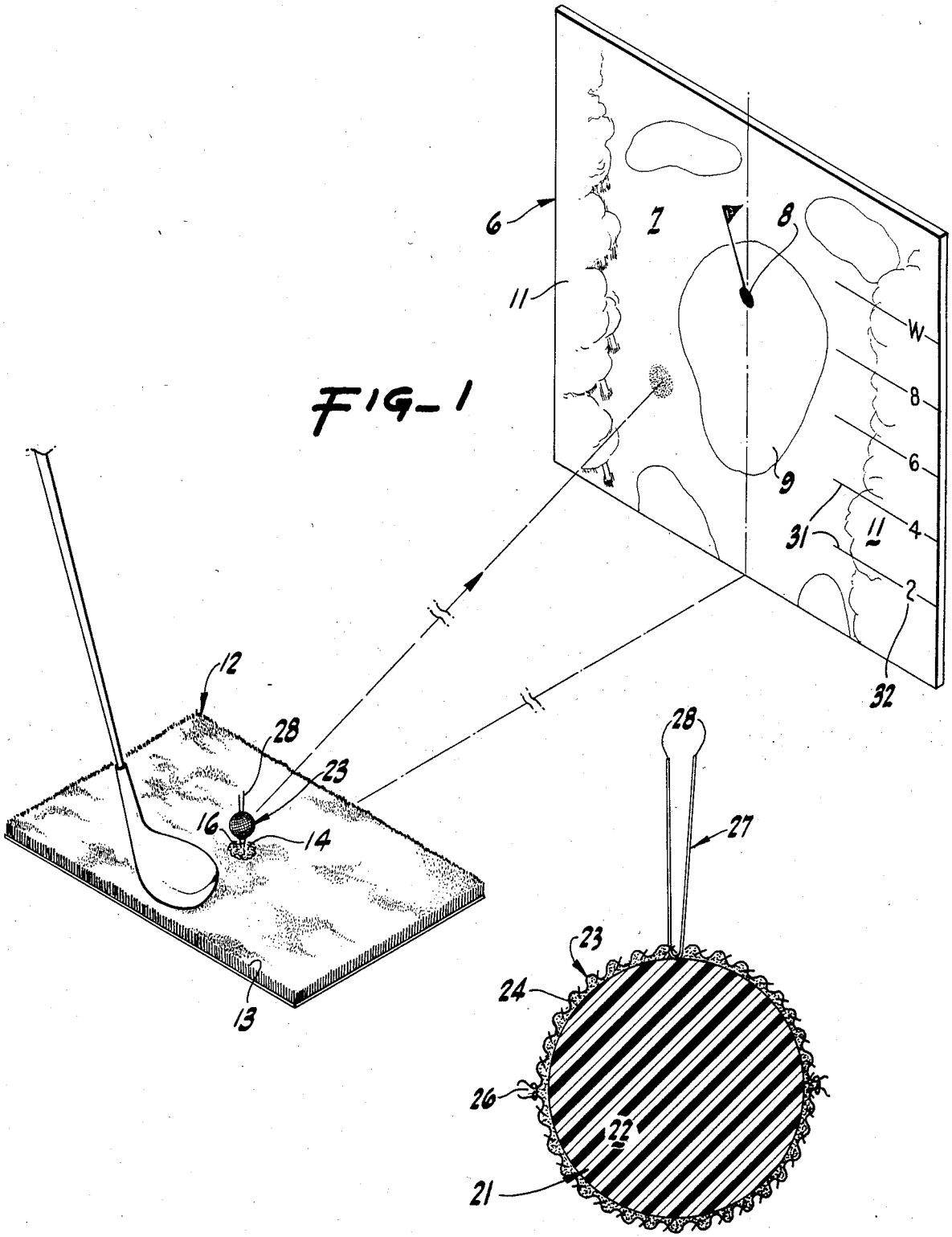
FIG. 1 is an isometric perspective showing a game playing setup in which the pellet of the invention is utilized.
FIG. 2 is a cross-section through a typical pellet constructed in accordance with the invention.

In order to permit a player to practice his golf swings, particularly for longer shots rather than putting, there is afforded a setup which can be utilized indoors and in the usual size room. On the room floor there is erected a target board 6, usually of plywood or the like, arranged substantially upright and adequately supported against impact. The face 7 of the board is conveniently demarked or decorated to illustrate a golf hole 8 and a surrounding green 9 as well as accompanying rough 11 or comparable typography. While there is no particular scale involved, it is convenient to have the green 9 appear to an observer just as a practical green would appear to him if he were many yards distant.

In the same room and disposed on the floor a short distance from the target 6; for example, about six or eight feet away, is a mat 12 conveniently of a flexible material having upstanding bristles 13 therein and also carrying a deposit 14 of a clayey material so as to receive the stem of a golf tee 16 of the customary construction. The arrangement is such that the tee stands above the mat 12 very much as a tee would appear under normal exterior circumstances, the clayey material 14 serving as a substitute for the earth.

For use in connection with this equipment there is provided a pellet 21. This is a substantially spherical body of a clayey, energy-absorbing material 22 of approximately the same configuration and size as the customary golf ball and approximately of the same weight. The precise material used can be any of several variations, such as modelling clay, some waxes and the like, preferably with an additive such as sand grains of different sizes. These increase the weight of the pellet, and they are readily reworked with the main pellet material as the pellet is reshaped after impact. The material 22 in generally spherical form is first encased in a pocket-like enclosure 23 of two-way stretch woven, knit or other fabric having small interstices 24 therethrough. The fabric is brought around the spherical core 21 and has its edges gathered and sewn together at a closure 26 so that in effect the exterior appearance of the pellet is substantially spherical and uniform and is like that of a golf ball.

In addition, the pellet is provided with a particular area marker 27. This can be accomplished in various different ways, but in the present case the cover at one site is provided with a number of extending filaments 28 of a readily visible color.

The cover 24 is especially provided with and carries a fine powder, which does not show in the drawing but is interrelated with the cover and occupies many of the interstices therein. The powder is a relatively fine, readily visible talc, preferably white. During normal handling of the pellet, the powder remains well in place. Nevertheless, upon hard impact of the pellet with a surface, the powder is shaken loose or dislodges and deposits on the impacting surface.

In the normal use of the structure, the powdered and covered pellet, in its generally spherical configuration, is placed on the tee 16 in the usual way of a golf ball. The player, standing on or near the mat 12, addresses the pellet in the usual fashion, customarily with an iron club with which he particularly desires to practice. He makes the customary swing against the pellet and dislodges and drives or impels the pellet toward the target 6, endeavoring to land the pellet in the vicinity of the hole 8.

As he does so, two things occur. First, the impact of the golf club face against the pellet dislodges some of the powder onto the club face so that the area or zone of impact can be readily discerned upon later looking at the club face. Also, the club face, usually not flat but scored or serrated, makes a comparable imprint in the surface of the deformable pellet. Upon examination thereof subsequently it can readily be determined just where and at what orientation the club face contacted the pellet.

In addition, the pellet absorbs much of the impact energy by deforming out of the spherical shape to afford a flattened face where the club head hit it and where it hits the target. The pellet does not spring back nor restore itself to its initial shape.

The second thing that occurs is that when the pellet hits the target, the impact is sufficient so that additional powder leaves the pellet covering and deposits on the target so as to afford an indication of the location where the target impact occurred.

If desired, the target 6 can contain a number of indicating markers 31 with indicia 32 simulating arbitrarily the number of yards that the pellet has travelled comparable to the true flight of an actual golf ball.

At the target the pellet is likewise flattened and so eventuates with two flattened faces the relationship of which to the initial position of the pellet and to each other is more readily gauged by reference to the marker 27 and filaments 28.

The impact of the club face leaves a corresponding approximately flat area on the pellet, and the customary grooves on the club face leave corresponding marks on the pellet. These can be visually compared with a corresponding flat area due to impact with the target as to location in order to estimate closely just how the pellet was hit and in what direction it rotated during flight. A close estimate of hooking or slicing can be made.

By the use of this structure the player can determine accurately where the impact of his club with the pellet has occurred, both as to position on the club face above the teedup portion and laterally with respect to the club shank. Furthermore, by observing the powder mark on the target he can determine how well his swing has propelled the ball to the desired target area; that is, whether there has been rotation during flight resulting in a hook or a slice.

Following a single use of the pellet, it can be retrieved and after examination can manually be pressed back into substantially its original spherical form for reuse.

Since the pellet is highly energy absorbing and soft and not springy, it cannot cause any substantial damage even if it misses the panel completely and hits other objects in the room.

It has been found that by repeated use of the setup described with the characteristic pellet that it is possible to improve the accuracy of golf shots sufficiently to reduce the number of strokes required in an actual game.

I claim:

1. A practice ball for golfers for use in simulated golf driving, comprising a core of substantially spherical configuration and formed of a moldable material sufficiently soft and non-springy to permit such spherical configuration to be flattened in the area of impact with the striking face of a golf club head a fabric cover around said core, and a readily dislodged powder in said cover.

2. A device as in claim 1 in which said fabric cover has interstices of a predetermined size less than sufficient to permit passage of said core material therethrough.

* * * * *